US006333075B1

(12) United States Patent
Ichikawa

(10) Patent No.: US 6,333,075 B1
(45) Date of Patent: Dec. 25, 2001

(54) METHOD OF FORMING A FILM ON STRIP MATERIAL AND APPARATUS THEREOF

(75) Inventor: Atsushi Ichikawa, Kuroiso (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/299,652

(22) Filed: Apr. 27, 1999

(30) Foreign Application Priority Data

Apr. 24, 1997 (JP) ..... 10-117192

(51) Int. Cl.[7] ..... B05D 1/18; B05D 3/04
(52) U.S. Cl. ..... 427/434.6; 427/348; 427/443
(58) Field of Search ..... 427/348, 349, 427/177, 434.6, 432, 443

(56) References Cited

U.S. PATENT DOCUMENTS 3,681,118 * 8/1972 Omaha et al. ..... 427/349
3,932,683 * 1/1976 Robins et al. ..... 427/349
4,304,822 * 12/1981 Heyl ..... 427/349
5,614,266 * 3/1997 Cox et al. ..... 427/349

FOREIGN PATENT DOCUMENTS 7-195116 8/1995 (JP) .

* cited by examiner

*Primary Examiner*—Brian K. Talbot
(74) *Attorney, Agent, or Firm*—Sughrue Mion, PLLC

(57) ABSTRACT

A simple and inexpensive method of forming a film on a wire or strip material by immersing it in a solution bath containing a film-treating component, and then draining liquid off, and an apparatus thereof are disclosed. The time from taking out the material from the solution bath to completing liquid draining is not less than 4 times the immersion time in the solution bath to thereby improve drawability.

11 Claims, 4 Drawing Sheets

METHOD OF FORMING A FILM ON STRIP MATERIAL AND APPARATUS THEREOF

BACKGROUND OF THE INVENTION

1. Field of the Invention

The present invention relates to a method of forming a film by continuously applying a film-forming treatment to a wire or strip material (hereinafter a material to be treated or being treated is referred to as "strip material") and an apparatus thereof. In particular, it relates to a method of simply and inexpensively forming a film having a desired thickness by immersing the strip material in a solution bath containing a film-forming component and then drying it, and an apparatus thereof.

2. Description of the Related Art

In a treatment of continuously drawing a steel wire with the use of a lubricant for dry drawing, generally, a borax (borax:$Na_2B_4O_7$) film is previously formed on a steel wire supplied from a pay off unit, and thereafter a drawing process is carried out through a series of drawing dies with the use of the lubricant for dry drawing.

The role of the borax film in drawing process is to carry the lubricant and also to prevent the die and the steel wire from directly touching each other. The thickness of the borax film is decreased with progression of the drawing process by falling off from the steel wire or elongation during drawing. In the case of continuous drawing process with a series of drawing dies, a certain thickness of the borax film on the steel wire is required even at the final die to prevent the die and the steel wire from directly touching each other. Therefore, it is necessary to form a borax film having a predetermined thickness prior to drawing, considering the reduction in film thickness during the drawing process. That is, in the case of drawing with a series of drawing dies, a thicker borax film is required when the total drawing amount is increased with a larger reduction in the section area of strip material per die and/or larger number of dies.

In such a film-forming treatment, first, strip material is immersed in a solution bath containing a film-forming component and taken out of the solution bath, and thereafter the solution remained on the strip material is drained by blowing or suction of a gas. In this case, the remaining solution should be finally drained to an extent that the remaining solution does not adhere to a jig such as a guide and the like which touches the wire before drying (hereinafter draining to this extent is referred to as "completion of draining").

The control of thickness of the film is mainly carried out by control of concentration of the film-forming component and the temperature of the solution bath. The concentration of the film-forming component in the solution bath cannot exceed the saturation limit, and also the temperature cannot exceed the boiling point, so that the amount of borax adhered on strip material, e.g. a wire material being continuously supplied and running, is limited. That is, the obtainable amount of drawing is limited because the film thickness cannot be made thicker than a limited value.

As a measure for solving such a problem that drawability is degraded due to the reduction in thickness of the borax film by progression of drawing, JP,7-195116A discloses a method of re-forming a borax film at an intermediate position of a series of drawing dies.

However, this method disclosed in the above publication has such a problem that additional units for heating and film-forming are required to be equipped at an intermediate position of a series of drawing dies. In any case, there has been a limit in thickness of a film on strip material formed by one continuous film-forming treatment without adding extra units such as a heating unit or a film-forming unit.

SUMMARY OF THE INVENTION

A purpose of the present invention is to provide a method and an apparatus for continuously forming a film on strip material by immersing the strip material in a solution bath containing a film-forming component and drying it, by which the desired thickness of the film can be obtained in a simple and inexpensive way even if the immersion time in the bath is short.

In order to achieve the above purpose, a method for forming a film on a strip material according to the invention comprises steps of immersing the strip material in a solution bath containing a film-forming component, taking the strip material out of the solution bath and draining, and is characterized in that the time from taking the strip material out of the solution bath to completion of draining is not less than 4 times the immersion time in the solution bath.

In the method according to the invention, the time from taking the strip material out of the solution bath to completion of draining is preferably 4–12 times, more preferably 4–8 times the immersion time in the solution bath. Moreover, the ambient temperature of atmosphere surrounding the strip material from taking the strip material out of the solution bath to completion of draining is preferably lower than that of the strip material itself, and furthermore, in a preferable draining step after the strip material is taken out of the solution bath, the strip material is blown on its peripheral surface by a gas flowing to the direction opposite to the running direction of the strip material. In this case, the flow rate of the gas is preferably not less than 30 m/sec, more preferably 40–55 m/sec.

In the method according to the invention, if the strip material is a steel wire or strip and the film-forming component is borax, temperature of the steel wire or strip from taking out of the solution bath containing borax to completion of draining is preferably 85–125° C., more preferably 95–115° C. In this case, the steel wire or steel strip can be heated before it is immersed in the solution bath containing borax. Further, it is preferable that the concentration of $Na_2B_4O_7$—$10H_2O$ in the solution bath containing borax is not less than 300 g/l, temperature of the solution is not less than 70° C., and the steel wire or steel strip is immersed in the solution bath for not more than 0.1 sec.

An apparatus for forming a film on strip material according to the invention comprises a heating unit for heating strip material being supplied from a pay off unit and run, a film-forming bath for immersion of the heated strip material therein, and a blowing unit for draining having a nozzle for blowing a gas on the peripheral surface of the strip material to a direction substantially parallel and opposite to the running direction of the strip material.

DESCRIPTION OF THE PREFERRED EMBODIMENT

Conventionally, a film-forming treatment on strip material such as a wire material and the like with borax and the like was carried out by immersing the strip material in a solution bath containing a film-forming component to form a film of the treating solution, and thereafter drying the strip material after draining of excessive solution remained on the strip material. In this process, draining of excessive solution was carried out by blowing or suction of a gas to a direction nearly perpendicular to the longitudinal direction of the strip material immediately after taking the strip material out of the solution bath. The inventor has considered that it is impossible to form a film thicker than a certain limitation, with such a conventional draining because the time from taking the strip material out of the solution bath to completion of draining is extremely short. Therefore, the inventor has made various investigations on the time until completion of draining, and found that a film thickness can be improved by setting the time not less than 4 times, preferably 4–12 times, more preferably 4–8 times the immersion time in the solution bath. However, even if the time is extended to more than or equal to 12 times the immersion time in the solution bath, it is difficult to increase the thickness of the film and have good properties.

In a method of the present invention, in order to promote the deposition of film-forming component on the strip material by supersaturation of the component in the solution remaining on the strip material, the ambient temperature of atmosphere surrounding the strip material from taking the strip material out of the solution bath to completion of draining is preferably lower than that of the strip material.

In draining after taking the strip material out of the solution bath, the time from taking the strip material out of the strip solution bath to completion of draining can be extended to not less than 4 times the immersion time in the strip solution bath by blowing a gas (e.g. air) on the peripheral surface of the strip material to a direction substantially parallel and opposite to the running direction of the strip material. At the same time, the temperature of atmosphere surrounding the strip material can be made lower than that of the strip material by blowing a gas whose temperature is lower than that of the strip material. In this case, the flow rate of the gas is preferably not less than 30 m/sec, more preferably 40–55 m/sec. Moreover, air or any other gas such as nitrogen gas can be used for the blowing provided that the gas can blow away the excessive solution and can cool the liquid surface. Air is preferably used because of its convenience and cheapness.

Figure 1:
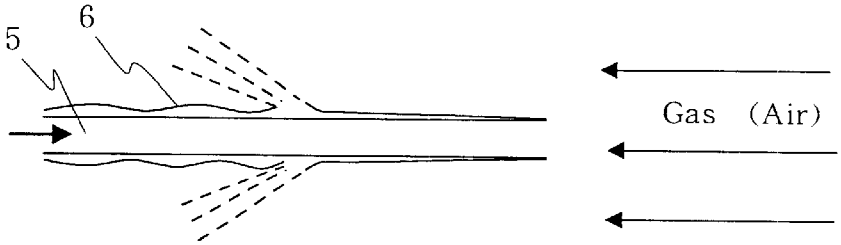
FIG. 1 is an explanatory view showing the draining state in an example of the present invention.

Concretely, as shown in FIG. 1, when the strip material is a wire material, the solution 6 remaining on the surface of the wire material 5 is swept up to the axial direction of the wire material 5 and drained by the gas blown on the peripheral surface of the wire material 5 in a direction substantially parallel and opposite to the running direction of the wire material. By this method, the time for completion of draining can be made longer compared with the conventional method in which a gas is blown to a direction nearly perpendicular to the longitudinal direction of the wire material 5. Also draining can be done uniformly over the whole peripheral surface of the wire material 5. In this process, the wire material and the solution on it, both having high temperature, are cooled by blowing the gas, and the film-forming component in the solution is deposited by supersaturation. In the present invention, the deposition from the solution is effectively performed because the solution for the deposition is enriched by sweeping up before cooling. Also, time for completion of draining can be extended. As a result, a thicker film can be obtained.

When the strip material is a steel wire or strip and the film-forming component is borax, the temperature of the steel wire or strip is preferably held 85–125° C., more preferably 95–115° C. from taking the steel wire or strip out of the solution bath containing borax to completion of draining.

By setting the temperature of the steel wire or strip as above, the temperature of the solution on the strip material can be made within such a range that promotes the deposition reaction at the interface between the solution and the strip material, and degree of concentration of the solution by evaporation of water and degree of supersaturation in cooling are increased at the interface between the solution and atmosphere. That is, if the temperature of the steel wire or strip is less than 85° C., it becomes difficult to increase the reaction rate of deposition from the solution on the strip material, and it also becomes difficult to increase degree of supersaturation due to the low cooling effect by atmosphere. On the other hand, if the temperature exceeds 125° C., the deposited film becomes porous by bumping of the solution on the strip material and the like, and thus the coating effect of the film is degraded.

The temperature of the steel wire or steel strip can easily be kept within the above temperature range by heating the steel wire or strip before immersing in the solution bath containing borax. In this case, it is preferable to immerse the steel wire or strip in the solution bath containing borax, whose concentration of $Na_2B_4O_7$—$10H_2O$ is preferably not less than 300 g/l and temperature is not less than 70° C., for not more than 0.1 sec, thereby adjusting the temperature of the steel wire or strip to an aimed temperature, and controlling the film to a desired thickness.

An apparatus for forming a film on strip material according to the invention comprises a heating unit for heating strip material being supplied from a pay off unit and run, a film-forming bath for immersion of the heated strip material therein, and a blowing unit for draining having a nozzle for blowing a gas on the peripheral surface of the strip material to a direction substantially parallel and opposite to the running direction of strip material. As to the heating unit, it can be made of a conventionally known unit for heating a steel wire or strip. Moreover, as to the film-forming bath, which is to contain a solution containing a film-forming component, it can be made of a bath conventionally used for such a immersion treatment. For example, a overflow-type bath can be used. Furthermore, the blowing unit is a unit successively provided with a blowing portion and a gas nozzle. The blowing portion and the gas nozzle will be explained in detail as follows.

The "blowing portion" includes a starting point of draining where the solution on the strip material is pushed back and atomized, and a completing point of draining where draining arrives at completion of draining. The blowing portion is designed so that completion of draining is achieved before the strip material enters into the gas nozzle to avoid undrained solution being carried into the gas nozzle and that time from taking out of the solution bath to completion of draining is predetermined value.

The gas nozzle is provided next to the blowing portion in the running direction of the strip material, and the gas nozzle is formed into a cylindrical tubular shape opened at both ends for passing the strip material and gas is introduced by means of a compressor and the like (not shown) via a gas introductory portion provided at the side face thereof. An opening diameter of the tubular nozzle is made small for obtaining such a flow rate that gas is effectively blown, but is made large enough to obtain a laminar flow of the gas parallel to the running direction of the strip material. In the following example, the nozzle diameter is about twice the diameter of the wire to be treated.

In order to control the direction of the gas so that the gas is blown from the nozzle toward the blowing portion, the gas introductory portion is inclined and arranged near the open end of the nozzle through which the strip material enters, to lengthen the distance between the place where the gas introductory portion is arranged on the nozzle to the other open end of the nozzle. Moreover, a laminar flow of the gas parallel to the running direction of the strip material can be effectively obtained by providing the gas introductory portion at two places across the nozzle tube.

As explained above, in the film-forming method according to the present invention, the time from taking the strip material out of the solution bath to completion of draining is not less than 4 times the immersion time in the solution bath, and the temperature of atmosphere surrounding the strip material from taking the strip material out of the solution bath to completion of draining is preferably lower than that of the strip material. As a result, the amount of the film formed on the strip material can be effectively increased. Thus drawability is remarkably improved when a borax film is formed on a wire for dry drawing by the method of the present invention. And as a result, the present invention is useful in industry.

The following example is given for the purpose for illustrating this invention and is not for showing limitations thereof.

Figure 2:
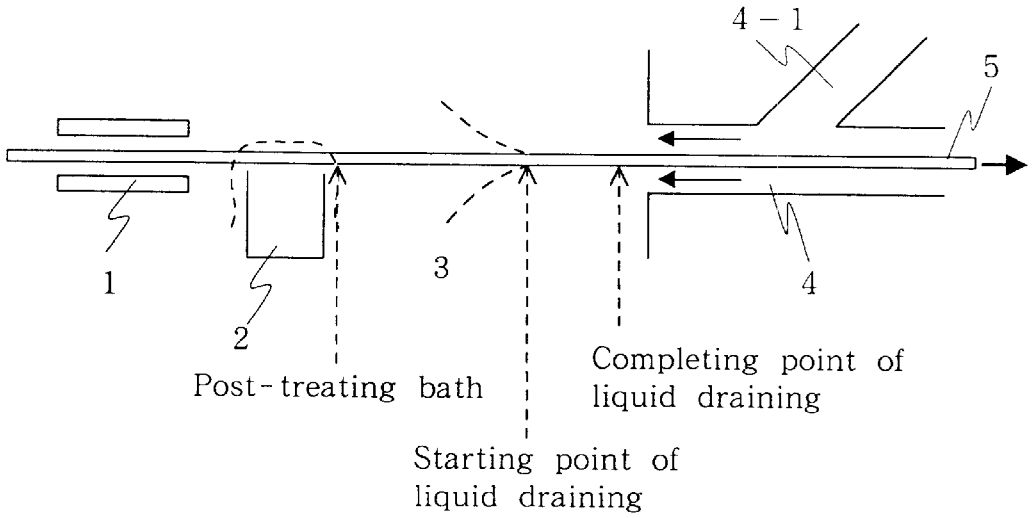
FIG. 2 is a schematic diagram of an apparatus for forming a film according to the present invention with a blowing unit for draining.
Figure 3:
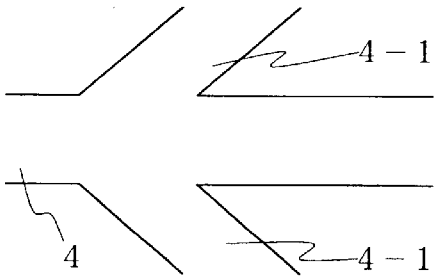
FIG. 3 is a sectional view showing another example of a nozzle.

FIG. 2 is a general view of an apparatus as one example of the present invention. The apparatus for forming a film on a wire material 5 comprises a heating unit 1, a film-forming bath 2, a blowing portion 3, a gas nozzle 4.

The film-forming bath 2 is filled with a solution containing 450 g/l of borax, and heated at 85° C. The gas (air) blowing portion 3 is a space positioned between the film-forming bath 2 and the gas nozzle 4, and a length of the space can be freely changed by changing arrangement of the nozzle 4 or the film-forming bath 2. The nozzle 4 is a cylinder opened at both ends for passing the wire material through it, and had a gas introductory portion 4-1 on its side face, through which the gas is introduced to the nozzle and blown from the nozzle toward the gas blowing portion 3. In this example, the gas flow rate is controlled to keep an arbitrary value within 0 to 100 m/sec.

A carbon steel wire material of 5.5 mm in diameter is used as strip material, and is supplied from a pay off unit and passed through successive units of the apparatus according to the present invention exemplified above to carry out a film-forming treatment. The carbon steel wire 5 is heated at the heating unit 1, immersed in the film-forming bath 2 of overflow type, passed through the blowing portion 3 in which air is blown on the peripheral surface of the wire 5 to a direction substantially parallel and opposite to the running direction of the wire 5, passed through the cylindrical part of the nozzle 4, and then dried. The carbon steel wire 5 with borax film thus formed on its surface is drawn in a dry drawing process. Before drawing, amount of borax film formed on the wire is measured for evaluation. In addition, drawability was evaluated to confirm an effect of the amount of borax film on drawability.

[Relation between time for completion of draining and amount of borax film]

Figure 4:
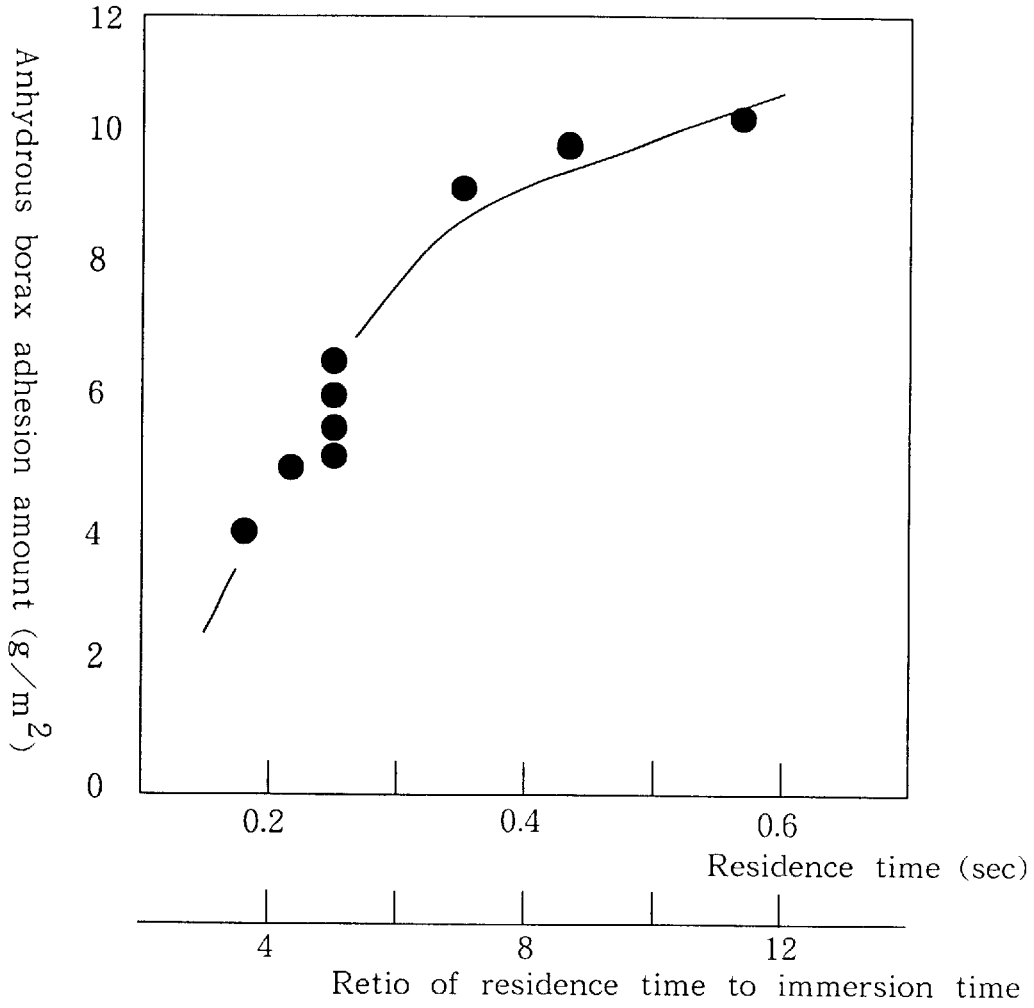
FIG. 4 is a graph showing a relationship between time (ratio to immersion time) from taking a wire out of the solution bath to completion of draining and amount of borax film formed on the wire.

The above treatment was carried out with some values for time from taking the wire material 5 out of the film-forming bath 2 to completion of draining (time for completion of draining) by changing the position of the film-forming bath 2. This treatment was carried out under such a condition that the immersion time of the wire material 5 in the film-forming bath 2 was 0.05 sec, the wire material 5 was heated to 140° C. before immersion, the temperature of the wire material 5 at the time of taking out of the film-forming bath was 105° C., and the flow rate of gas (air) blown from the nozzle was 45 m/sec at room temperature. FIG. 4 shows the relation between time for completion of draining and amount of borax film formed under these conditions. In a conventional method, draining was carried out immediately after taking out the wire material from the film-forming bath, so that the time up to completion of draining was not more than 0.1 sec, and was not more than 2 times the immersion time in the bath, and thus the amount of borax film was not more than 3 g/m$^2$. However, as the time for completion of draining was lengthened, the amount of borax film was increased. By the example of the present invention in which time for completion of draining was not less than 4 times the immersion time, that is 0.2–0.3 sec (ratio to immersion time: 4–6 times), amount of borax film was doubled to 4–8 g/m$^2$. Moreover, amount of borax film was gradually increased when the time for completion of draining was increased over not less than 0.35 sec (ratio to immersion time: 7 times).

Generally, in a conventional method of blowing or suction of a gas for draining liquid from a wire material, the blowing or suction of a gas was carried out from a direction perpendicular to the running direction of the wire material immediately after taking out the wire material from the film-forming bath. In this case, the time from start to completion of draining was very short, and draining was completed as soon as the wire material was taken out of the bath. On the contrary, as shown in this example of the invention, in the method of blowing a gas (air) on the peripheral surface of the wire material to a direction opposite to the running direction of the wire material, the time from taking out of the bath to completion of draining was able to be made longer than that in the conventional method because the draining from start to completion was able to be carried out at a lower rate for a longer time.

[Relation between ambient temperature of atmosphere and amount of borax film]

Figure 5:
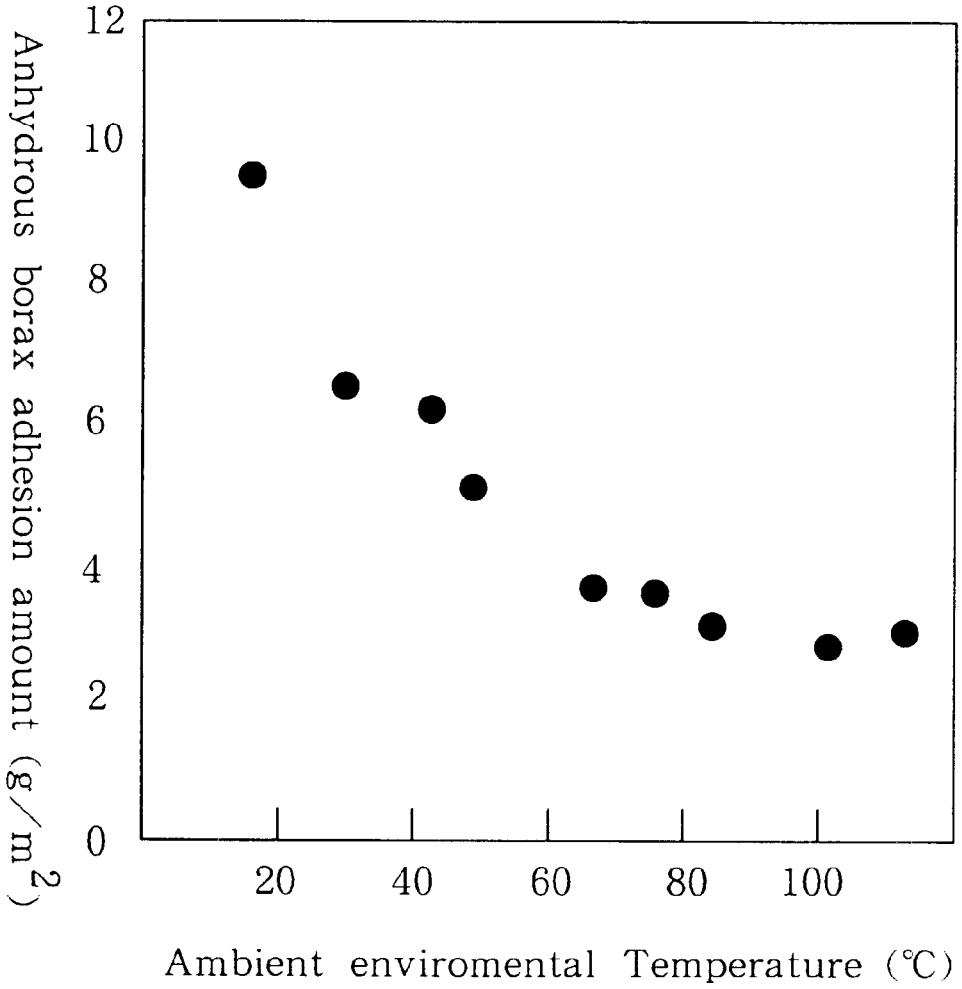
FIG. 5 is a graph showing a relationship between ambient temperature of atmosphere in draining and amount of borax film formed on the strip material.

Next, the aforementioned treatment was carried out with various ambient temperature of atmosphere surrounding the strip material from taking out of the film-forming bath to completion of draining with the use of aforementioned apparatus. Ambient temperature of atmosphere was varied by changing temperature of air blown from the nozzle in a range from room temperature to 110° C. Here, the flow rate of air blown for draining was 45 m/sec, and time from taking out of the bath to completion of draining was 6 times the immersion time. As shown in FIG. 5, it is understood that the amount of borax film can be increased by lowering ambient temperature of atmosphere in draining.

In the blowing method according to the present invention, cooling of the solution on the surface of wire material from start to completion of draining can be effectively carried out by using air of lower temperature for blowing on the surface of the wire material.

[Relation between draining flow rate and amount of borax film]

Figure 6:
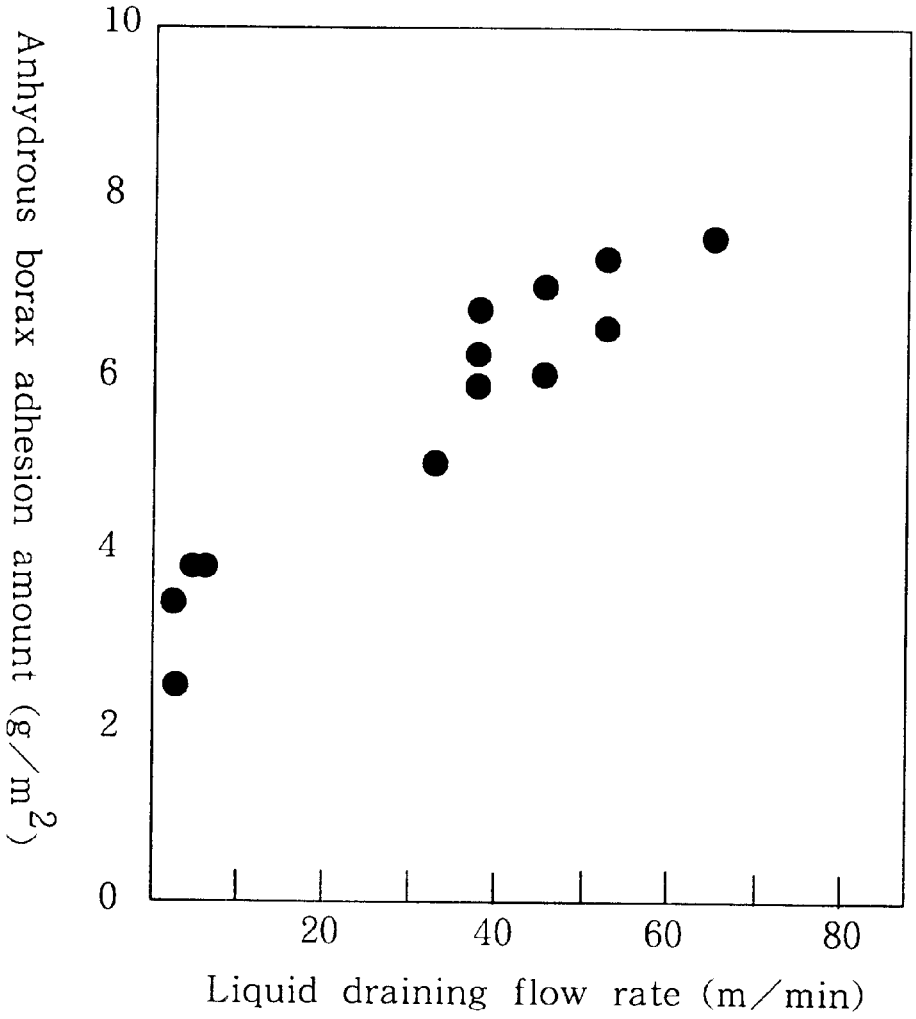
FIG. 6 is a graph showing a relationship between flow rate of a gas blown for draining and amount of borax film on the strip material.

FIG. 6 shows a relation between flow rate of the gas (air) blown from the nozzle for draining (draining flow rate) and amount of borax film (which corresponds to thickness of borax film). It is understood that amount of anhydrous borax adhering on the wire material can be doubled or tripled from about 3 $g/m^2$ to about 8 $g/m^2$ when draining flow rate is increased from 0 to 60 m/sec.

As described above, in the example in which time for completion of draining was made not less than 4 times the immersion time, amount of anhydrous borax adhering on the wire material was increased from conventional value of about 3 $g/m^2$ to about 11 $g/m^2$ by controlling the time for completion of draining and cooling of the treating solution on the wire material during draining, and thus a thicker film was suitably obtained.

[Relation between amount of borax film and drawability]

Next, the aforementioned treatment was carried out with some values for temperature of the wire material from taking out of the bath to completion of draining, and drawability of resulting wire was evaluated.

The amount of borax film necessary for preventing a die and a wire from directly touching each other in dry drawing is at least 1 $g/m^2$. In the case of successively drawing with a series of drawing dies, the thickness of the anhydrous borax film is successively decreased. However, the obtainable total reduction in the section area of strip material until the film thickness was decreased to a minimum necessary value was increased by increasing the amount of anhydrous borax film formed before drawing. That is, for a carbon steel wire material having carbon content of 0.7 or 0.8 wt % and diameter of 5.5 mm, the diameter was not able to be reduced to less than 1.50 mm with total area reduction of more than 92% by continuous drawing when amount of anhydrous borax film formed on the wire before drawing was 3 $g/m^2$. However, the diameter was able to be reduced to 0.9 mm with total area reduction of 97% by continuous drawing when amount of anhydrous borax film formed on the wire before drawing was 6 $g/m^2$.

In manufacture of a steel cord, in which the diameter of steel wire material is generally 5.5 mm and is reduced to 1.5–0.9 mm by dry drawing, preferable range for thickness of anhydrous borax to be formed on the steel wire material before drawing corresponds a range between about 6 and 8 $g/m^2$ for amount of anhydrous borax adhering on the wire material.

The above example relates to a formation of a borax film on a steel wire material, but the effect is not limited to a treatment of a wire material and can be obtained when the same method is applied to a treatment of a ribbon-like strip material. In this case, spraying of the solution to the strip material by a spraying device can be adopted instead of immersion In a solution bath. Moreover, temperature of the strip material from taking out of the bath to draining can be controlled by heating the strip material during draining instead of heating the strip material before immersion in the solution bath.

Furthermore, application of the method of the present invention is not limited to forming a borax film. The same effect can be obtained when the method of the invention is applied to forming of other film from a solution containing other film-forming component such as potassium borate, or zinc phosphate as an undercoating for improving durability of painting or as a lubricating film for processing.

What is claimed is:

1. A method for forming a film on a steel strip or steel wire material comprising steps of; immersing the material in a solution bath containing borax as a film-forming component, taking the material out of the solution bath and draining the solution adhering on the material taken out of the solution bath, wherein the time from taking the material out of the solution bath to completion of draining is not less than 4 times the immersion time in the solution bath.

2. A method of forming a film according to claim 1, wherein the time from taking the material out of the solution bath to completion of draining is 4 to 12 times the immersion time in the solution bath.

3. A method of forming a film according to claim 2, wherein the time from taking the material out of the solution bath to completion of draining is 4 to 8 times the immersion time in the solution bath.

4. A method of forming a film according to claim 1, wherein ambient temperature of atmosphere surrounding the strip material from taking the strip material out of the solution bath to completion of draining is lower than that of the material.

5. A method of forming a film according to claim 1, wherein the material is blown on its peripheral surface by a gas flowing to a direction opposite to the running direction of the material in the step of draining the solution adhering on the material taken out of the solution bath.

6. A method of forming a film according to claim 5, wherein the flow rate of the gas is not less than 30 m/sec.

7. A method of forming a film according to claim 6, wherein the flow rate of the gas is not less than 40 to 55 m/sec.

8. A method of forming a film according to claim 1, wherein temperature of the steel wire or steel strip is 85–125° C. during the time from taking out of the solution bath to completion of draining.

9. A method of forming a film according to claim 8, wherein temperature of the steel wire or steel strip is 95–115° C. during the time from taking out of the solution bath to completion of draining.

10. A method of forming a film according to claim 8, wherein the steel wire or steel strip is heated prior to immersing in the solution bath.

11. A method of forming a film according to claim 10, wherein concentration of $Na_2B_4O_7$—$10H_2O$ is not less than 300 g/l in the solution bath, temperature of the solution bath is not less than 70° C. and the immersion time in the solution bath is not more than 0.1 sec.

* * * * *